US010370891B2

(12) United States Patent
Farahmandpour

(10) Patent No.: US 10,370,891 B2
(45) Date of Patent: Aug. 6, 2019

(54) ADJUSTABLE THRESHOLD DEVICE

(71) Applicant: Kamran Farahmandpour, Long Grove, IL (US)

(72) Inventor: Kamran Farahmandpour, Long Grove, IL (US)

( * ) Notice: Subject to any disclaimer, the term of this patent is extended or adjusted under 35 U.S.C. 154(b) by 0 days.

(21) Appl. No.: 15/728,851

(22) Filed: Oct. 10, 2017

(65) Prior Publication Data

US 2019/0106929 A1 Apr. 11, 2019

(51) Int. Cl.
*E06B 1/70* (2006.01)

(52) U.S. Cl.
CPC ..... *E06B 1/70* (2013.01)

(58) Field of Classification Search
CPC ..... E06B 1/70
USPC ..... 49/468
See application file for complete search history.

(56) References Cited

U.S. PATENT DOCUMENTS

| | | | | |
|---|---|---|---|---|
| 1,729,243 | A | 3/1928 | Bricker | |
| 1,936,641 | A | 3/1931 | Plym | |
| 2,976,584 | A | 6/1959 | Ghormley | |
| 3,374,579 | A * | 3/1968 | Neff | E06B 7/2316 49/468 |
| 3,967,412 | A | 7/1976 | Govrnale | |
| 4,104,830 | A | 8/1978 | Eagle | |
| 4,387,535 | A | 6/1983 | Corbo | |
| 5,029,991 | A | 7/1991 | Daniels | |
| 6,345,477 | B1 | 2/2002 | Kelper | |
| 7,472,516 | B2 | 1/2009 | Pepper | |
| 7,669,369 | B2 | 3/2010 | Henry | |
| 8,074,699 | B2 | 12/2011 | Jones | |
| 9,127,503 | B2 | 9/2015 | Petta | |
| 9,528,314 | B2 | 12/2016 | Mitchell | |
| 2006/0283090 | A1 | 12/2006 | Moody | |
| 2008/0229669 | A1 | 9/2008 | Abdollahzadeh et al. | |
| 2010/0031578 | A1 | 2/2010 | Hartwell | |
| 2013/0199100 | A1 * | 8/2013 | Van Camp | E06B 1/70 49/468 |
| 2013/0305610 | A1 * | 11/2013 | Meeks | E06B 1/70 49/471 |
| 2014/0259951 | A1 | 9/2014 | Karl | |
| 2015/0013232 | A1 | 1/2015 | Rager-Frey | |
| 2017/0016268 | A1 | 1/2017 | Reyes | |

(Continued)

FOREIGN PATENT DOCUMENTS

| | | | | |
|---|---|---|---|---|
| CA | 2928089 | A1 * | 11/2016 | E06B 7/18 |
| CN | 104453566 | A | 3/2015 | |
| KR | 20130113280 | A | 10/2013 | |

*Primary Examiner* — Jerry E Redman
(74) *Attorney, Agent, or Firm* — Erickson Law Group, PC

(57) ABSTRACT

An adjustable door threshold device is disclosed. The device has a user-traversable threshold surface, a transverse surface, and a lift mechanism. The user-traversable threshold surface has a first surface portion and a second surface portion. The transverse surface is positioned transverse to the first surface portion and between the first surface portion and second surface portions. The lift mechanism is operable to move the first surface portion from a lowered position to a raised position. When the first surface portion is in the lowered position the first surface portion is recessed from the second surface portion and the transverse surface extends above the first surface portion for overlapped mating with a door lip.

20 Claims, 14 Drawing Sheets

(56) References Cited

U.S. PATENT DOCUMENTS

| | | | | |
|---|---|---|---|---|
| 2017/0051544 | A1 | 2/2017 | Bertelli et al. | |
| 2017/0058592 | A1* | 3/2017 | Meeks | E06B 1/70 |

* cited by examiner

ADJUSTABLE THRESHOLD DEVICE

FIELD OF THE INVENTION

The present invention relates to adjustable threshold devices.

BACKGROUND

Door thresholds may be configured to provide a seal between the threshold and the bottom of the door. U.S. Pat. No. 9,127,503 discloses a sill assembly having a component for overlapping with a door. U.S. Pat. Nos. 2,976,584, 1,936,641, and 1,729,243, disclose a threshold or a sill having a component for overlapping with a plate or a strip extending from the door. However the devices of these patents do not disclose a surface that is risible to cover a door lip mating surface.

The present inventor recognized that it would be desirable to provide a threshold that has an upward extending mating surface when the door is closed to provide increased thermal and weather sealing, but also provides a substantially unobstructed threshold for a user to traverse when the door is open. The president inventor recognized that providing a substantially unobstructed user-crossable threshold increases the ease with which users can cross the threshold. The present inventor recognized that this can be beneficial for persons with disabilities and for persons attempting to move items across the threshold, whether with the use of wheels or otherwise. The present inventor recognized that a substantially unobstructed threshold reduces a tripping hazard at the threshold and therefore has the potential to reduce accidents and injuries.

SUMMARY

An adjustable door threshold device is disclosed. The device has a user-traversable threshold surface, a transverse surface, and a lift mechanism. The user-traversable threshold surface has a first surface portion and a second surface portion. The transverse surface is positioned transverse to the first surface portion and between the first surface portion and second surface portion. The lift mechanism is operable to move the first surface portion from a lowered position to a raised position. When the first surface portion is in the raised position adjacent portions of the first surface portion and the second surface portion are substantially horizontally aligned and the transverse surface does not extend substantially above the first surface portion. When the first surface portion is in the lowered position the first surface portion is recessed from the second surface portion and the transverse surface extends above the first surface portion for overlapped mating with a door lip.

In some embodiments, the first surface portion moves as a consequence of the movement of a door at the threshold. When the door is opened, the first surface portion will move to the raised position so that there is substantially unobstructed pathway across the door threshold. When the door closes the first surface portion will lower to expose transverse surface. And the door lip extending from the door will overlappingly mate with the transverse surface.

Numerous other advantages and features of the present invention will become readily apparent from the following detailed description of the invention and the embodiments thereof, from the claims, and from the accompanying drawings.

DETAILED DESCRIPTION OF THE EMBODIMENTS

The following description is presented to enable any person skilled in the art to make and use the invention. For the purposes of explanation, specific nomenclature used provides a plural understanding of the present invention. While this invention is susceptible of embodiment in many different forms, the drawings and this description demonstrate specific embodiments of the invention with the understanding that the present disclosure is to be considered as an exemplification of the principles of the invention and is not intended to limit the invention to the specific embodiments illustrated.

Figure 1:
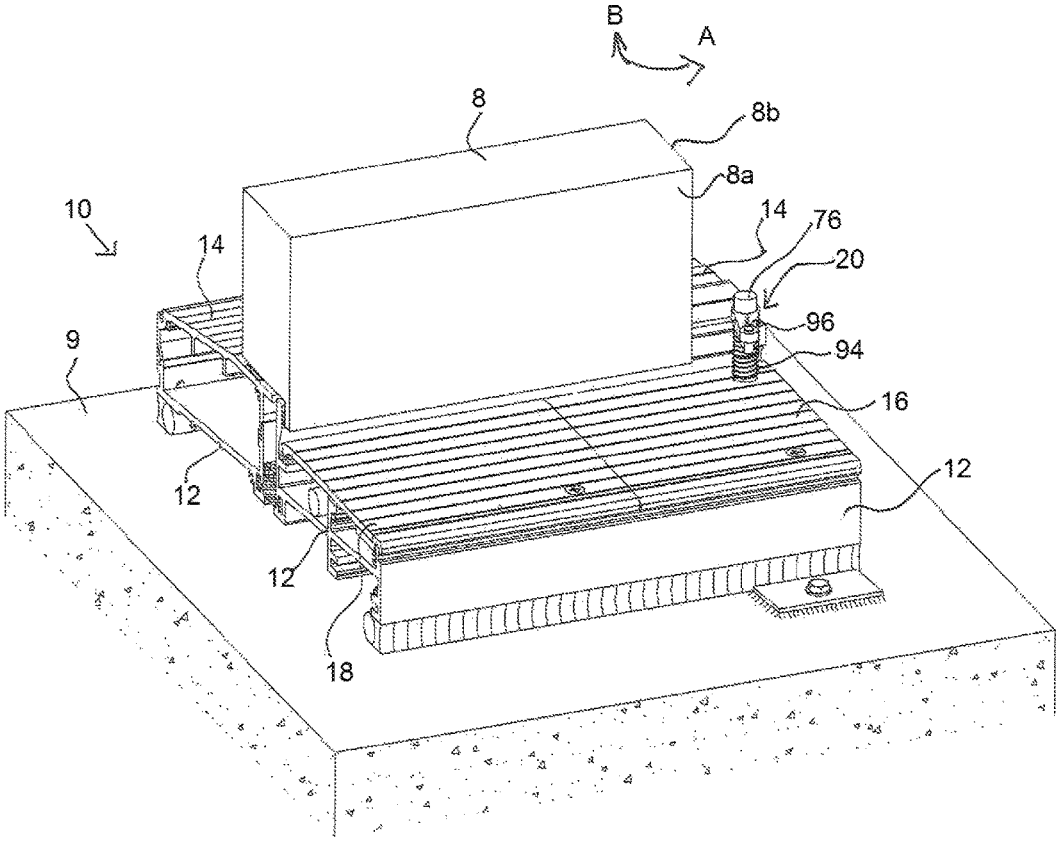
FIG. 1 is a perspective view of a first embodiment of an adjustable threshold device and a door.

One embodiment of an adjustable threshold device 10 is shown in FIG. 1. The device 10 comprises a subsill assembly 12, an exterior top plate 14, an interior top plate 16, an interior movable plate 18, a door lever assembly 20, and a linear actuator, such as a cam 22. The device is shown in use with one door in FIG. 1, but could be used with multiple doors. The device can be produced in any width and depth desired for a given application.

The subsill assembly 12 comprises an interior subsill 24 and an exterior subsill 26. The interior and exterior subsills 24, 26, are joined by a thermal break 28. In some embodiments, the thermal break is or comprises a plastic, such as polyamide. The subsills 24, 26, each comprises a t-shaped joining channel 34, 36, which receive corresponding t-shaped portions 30, 32 of the thermal break. The thermal break joins or bridges the subsills 24, 26.

Figure 8:
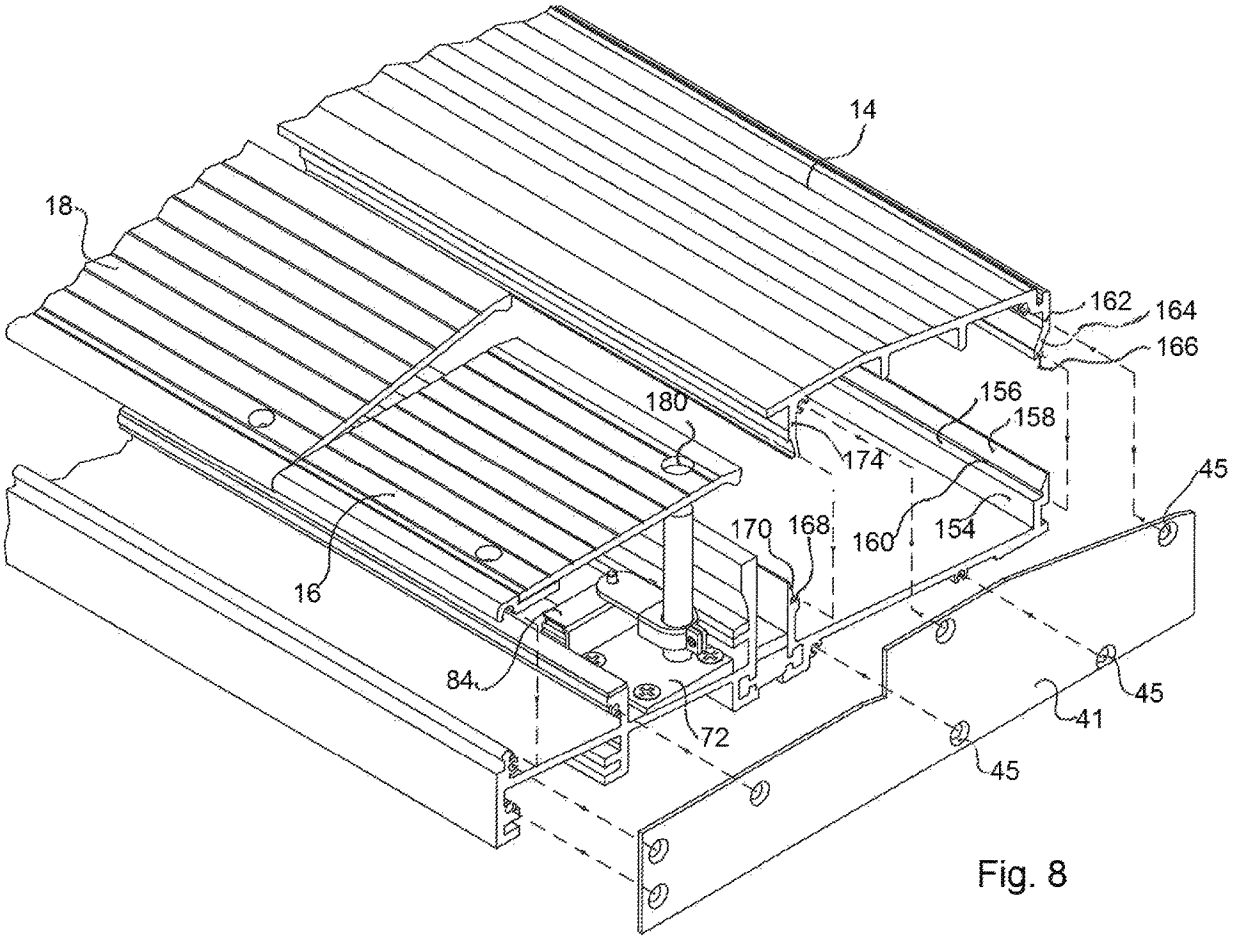
FIG. 8 is an exploded perspective view of the device of FIG. 1.
Figure 9:
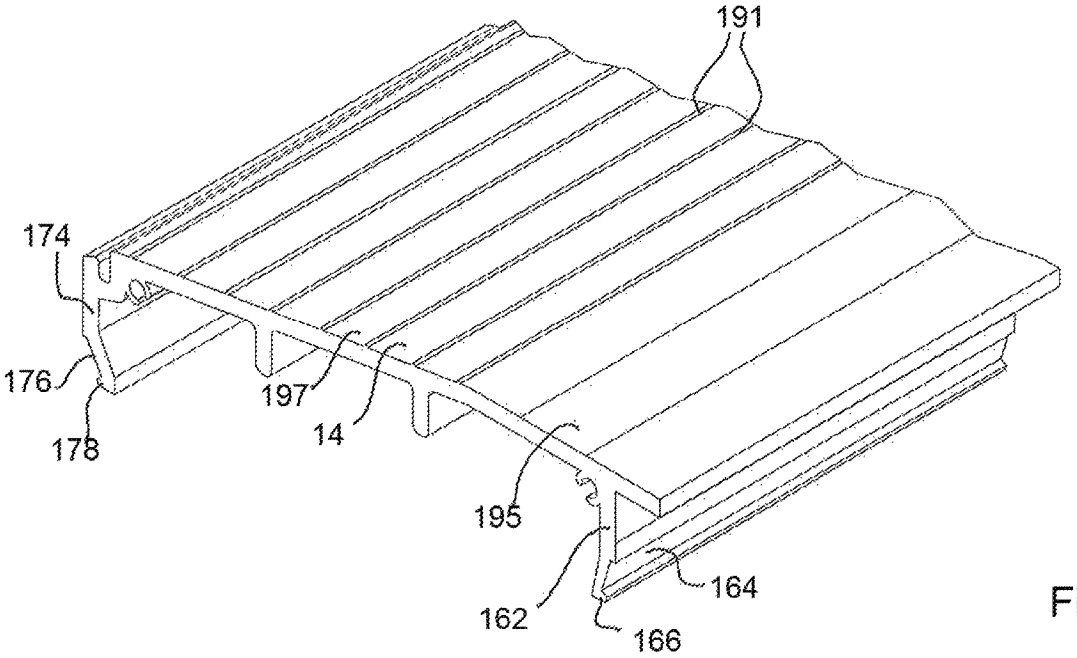
FIG. 9 is a fragmented view of an exterior plate of the device of FIG. 1.

The subsill assembly 12 may comprise opposite side plates, such as side plate 41 shown in FIG. 8. Fasteners (not shown) fix the side plate 41 to the subsill assembly and the plates 14, 16, 18. The fasteners extend through apertures 45 in side plate 41 to corresponding apertures or channels 43 in the subsill assembly 12 and plates 14, 16, and 18.

Figure 5:
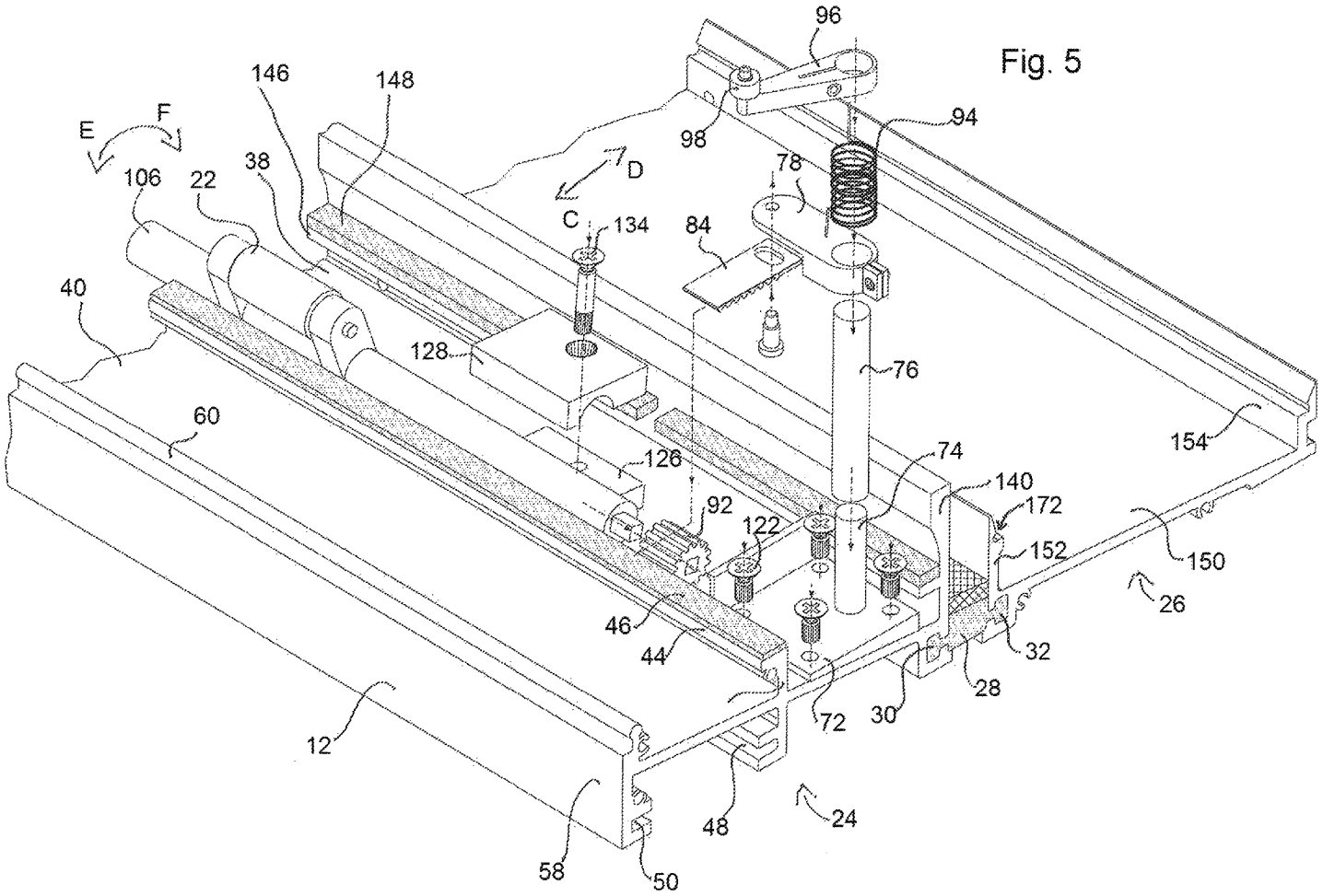
FIG. 5 is an exploded perspective view of the device of FIG. 1 with certain parts not shown.

As shown in FIG. 5, the interior subsill 24 comprises a first floor 38 and a second floor 40. The first and second floors are intersected by a first vertical wall 42. At the top of the first vertical wall is a platform 44. On the platform is a first gasket 46, which may be or comprise rubber. The first vertical wall extends below the first and second floors and provides support for a first mounting channel 48. The first mounting channel 48 is opposite a second mounting channel 50. A plate 54 of a mounting bracket or retainer clip 52 is received in the first and second mounting channels 48, 50. The mounting bracket or retainer clip 52 is fastened to a floor 9, which may be a concrete slab floor, by a fastener 56. The first and second mounting channels 48, 50 are located below the second floor 40.

Figure 2:
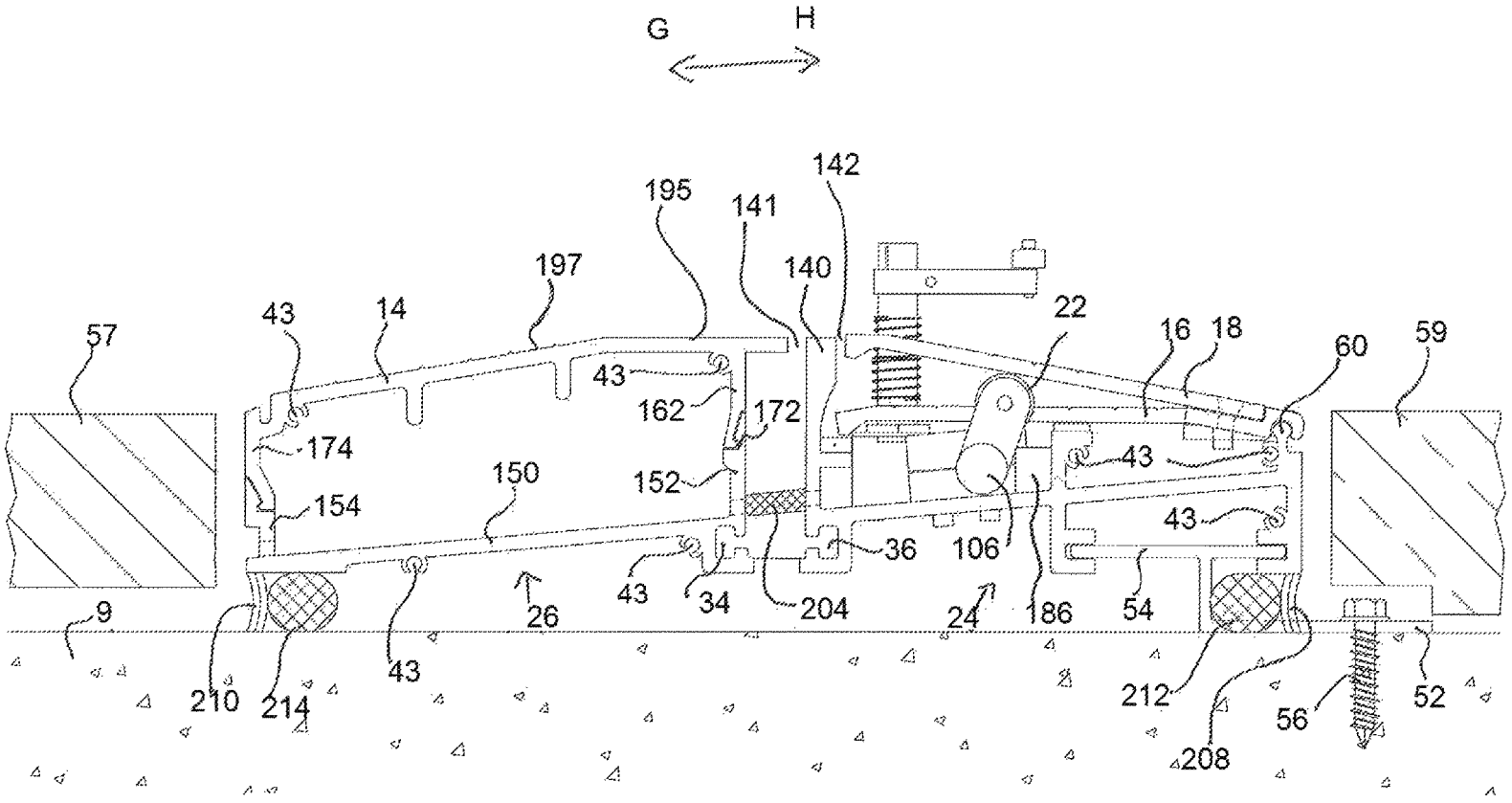
FIG. 2 is a left side view of the device of FIG. 1.
Figure 4:
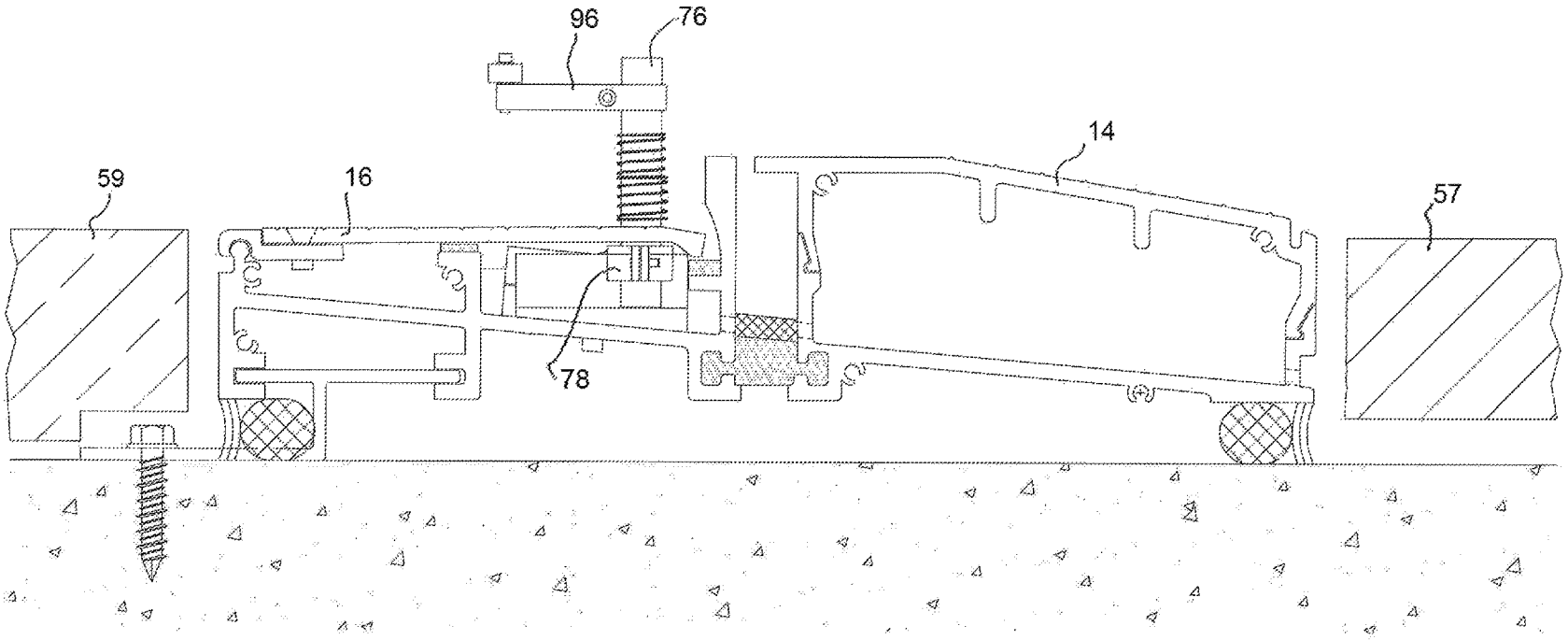
FIG. 4 is a right side view of the device of FIG. 1 with an interior plate in a lowered position.
Figure 7:
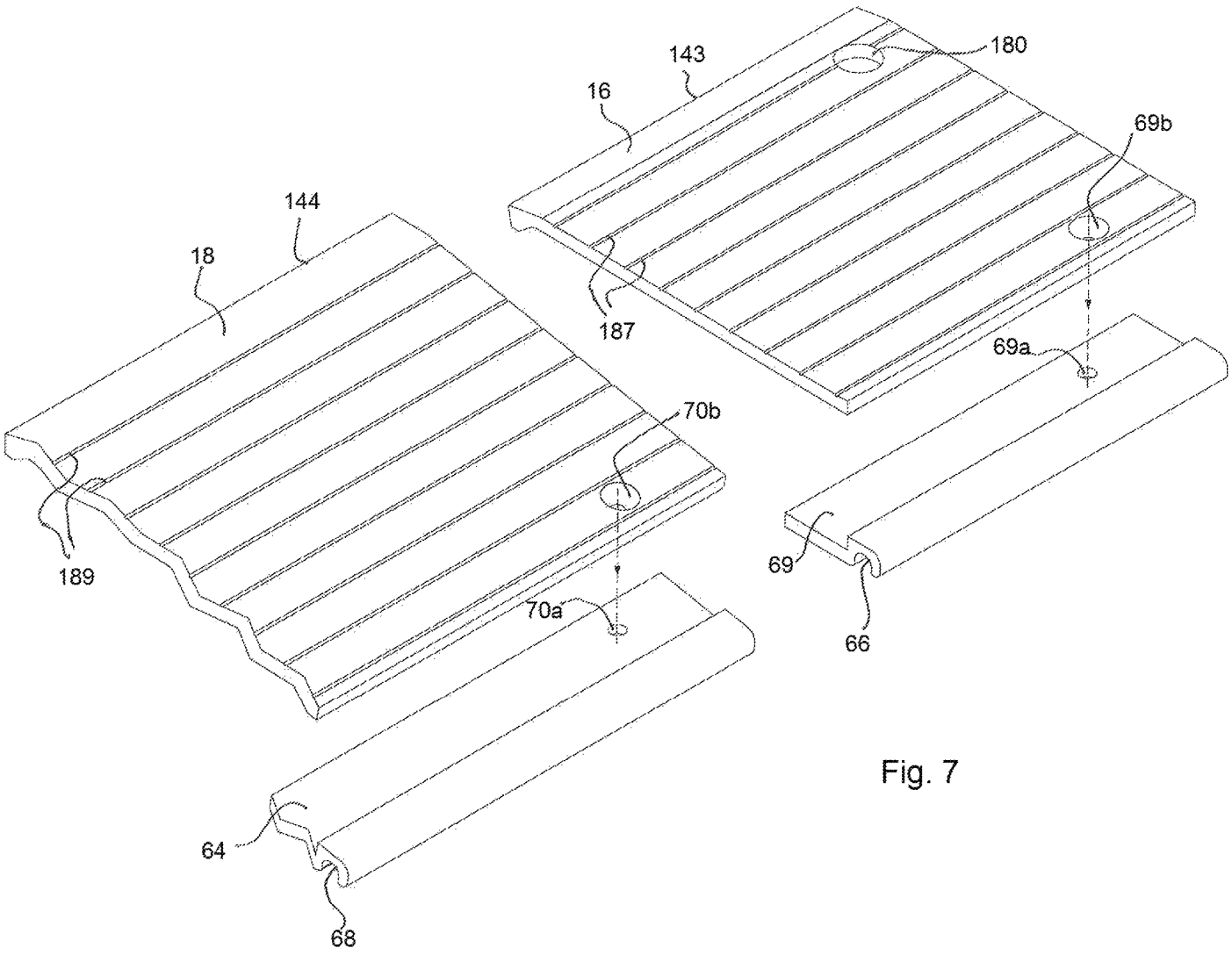
FIG. 7 is an exploded perspective view of certain interior plates of the device of FIG. 1.

Opposite the first vertical wall 42 across the second floor 40 is a front wall 58. At the top of the front wall 58 is a pivot mount 60, the pivot mount may be curved, circular, or partially curved or circular in cross-section. The plates 14 and 16 each comprise front lip portions 62, 64, respectively, as shown in FIG. 7. The front lip portions 62, 64 each comprise recesses 66, 68, respectively. The recesses 66, 68 receive the pivot mount 60 to join the plates 14, 16 to the subsill 24. The recess 68 is a pivot recess, and the plate 18 is pivotal about the pivot mount 60 between a raised position, as shown in FIG. 2, and a lowered position, as shown in FIGS. 1 and 4. The front lip portions 62, 64 may be fixed to the plates 14, 16, respectively with fasteners (not shown) at apertures 69*a*, 69*b*, 70*a*, 70*b*.

Figure 6:
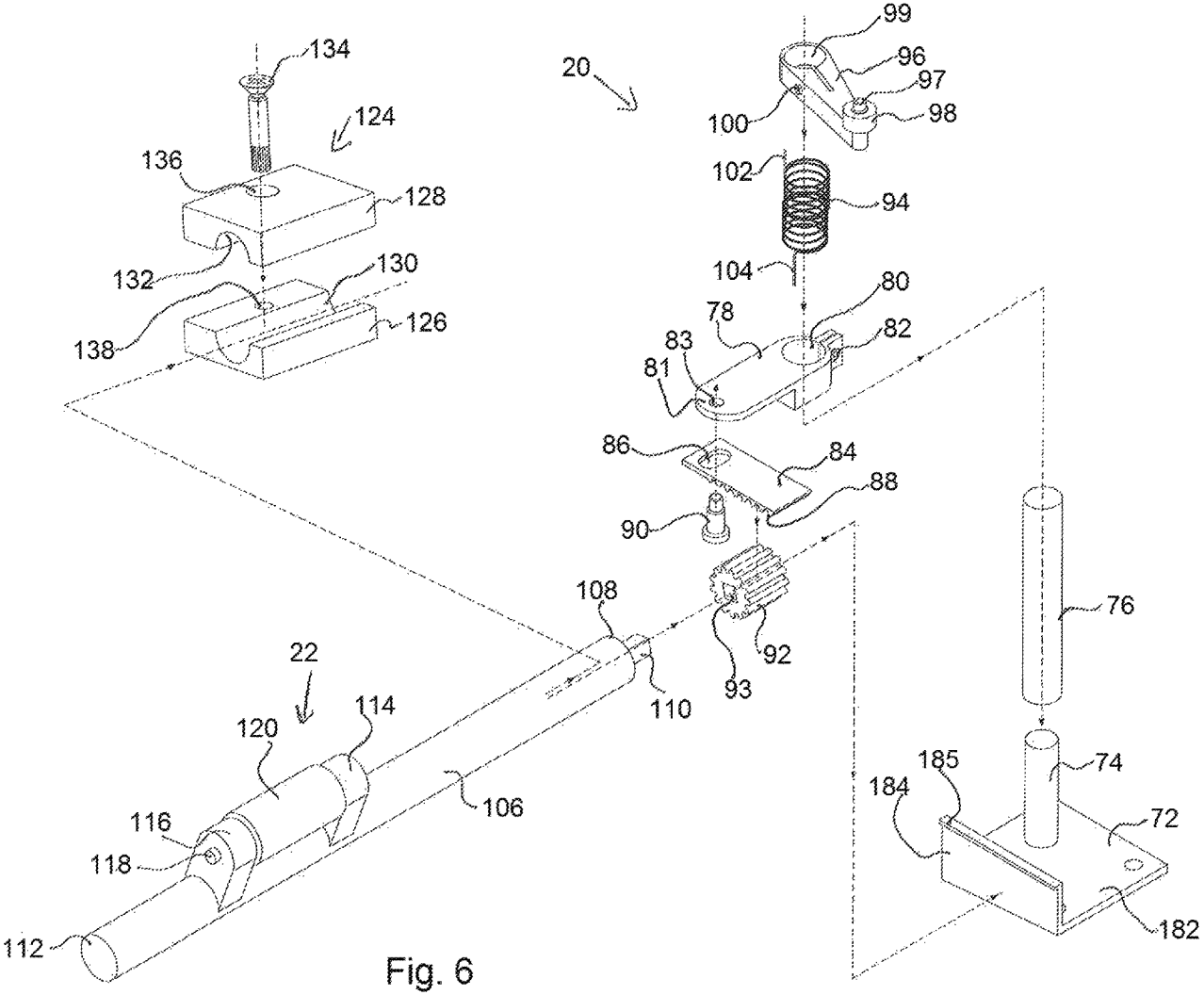
FIG. 6 is an exploded perspective view of a door lever assembly and cam of the device of FIG. 1.

At and above the first floor 38 is the door lever assembly 20 and the cam 22. Referring to FIG. 6, the door lever assembly 20 comprises a base plate 72, a shaft 74, a hollow shaft or bushing 76, an actuation lever 78, an actuation rack 84, a spring 94, and a door lever 96. The actuation lever 78 comprises a mounting aperture 80 and a lock bolt 82. The lever 78 is received about the hollow shaft 76 at the mounting aperture 80 and the lock bolt 82 secures the lever about the hollow shaft 76 by compression force. The hollow shaft 76 is pivotal about the shaft 74. The rack 84 comprises a fastener aperture 86. A fastener, such as a shoulder screw 90, connects the rack 84, via the aperture 83, to an end 81 of the lever 78.

The door lever 96 comprises a shaft aperture 99 and a door lever cam 98 opposite the aperture 99. The door lever cam 98 is mounted to rotate on shaft 97 extending from lever 96. The lever 96 is fixed to the shaft 76 at the aperture 99. A door lever lock bolt 100 operates to shrink the aperture 99 to grip the shaft 76 and hold the lever 96 relative to the shaft 76.

A spring 94 is connected to the lever 96 to bias the lever 96 and the door lever assembly 20 to a home position. In some embodiments, the spring 94 has an upper extension 102 and a lower extension 104. The upper extension 102 engages the lever 96 and the lower extension 104 engages a fixed component, such as the base plate 72. When the lever 96 is moved in the direction A, about shaft 74, the lever moves the upper extension 102 rotationally about shaft 76 to cause the spring 94 to further coil. The bias of the spring 94 urges the lever in the opposite direction of the additional coiling. When the lever is not restrained by contact with the door 8, the spring moves the lever 96 rotationally in the direction B and the door lever assembly 20 to the home position, as shown in FIG. 1.

The base plate 72 is fixed to the first floor 38 by one or more fasteners 122. A camshaft 106 is mounted to the first floor 38 by a bearing block assembly 124. The bearing block assembly 124 comprises a bottom bearing block 126, and a top bearing block 128. The bearing blocks 126, 128 each comprise a camshaft recesses 130, 132, respectively. The camshaft recess 130, 132 are configured to surround and mate with the camshaft 106. As a result, the recesses may be cylindrical when the camshaft is cylindrical. The blocks 126, 128 completely surround the camshaft at the location of intersection with the camshaft. The blocks 126, 128 can be joined together with a fastener 134, extending into or through apertures 136, 138. In some embodiments, the same fastener that joins the blocks 126, 128 together extend through each block and into the first floor 38 to secure the blocks 126, 128 to the floor 38. The blocks then hold the camshaft in position relative to the floor and relative to the rack 84. The camshaft can rotate within the bearing blocks 126, 128.

The camshaft 106 comprises a cam 22. In some embodiments, the cam 22 comprises a roller 120. First and second arms 114, 116 extend from the camshaft 106. A central pin 118 is fixed to the first and second arms 114, 116. The central pin extends through the roller 120 and the roller rotates about the central pin between the first and second arms 114, 116. In some embodiments, the cam is located closer to a distal end 112 of the camshaft and farther from a proximal end 108 of the camshaft. However, the cam can be located at any place along the camshaft. While the camshaft is shown with only one cam, in some embodiments multiple cams are provided along the camshaft.

An interface element 110 is located at the proximal end 108 of the camshaft. The interface element may comprise a square, pentagon, hexagon, or other polygon cross-section to mate with a correspondingly shaped central aperture 93 of the pinion 92. The pinion/gear has a toothed perimeter surface. The teeth of the rack 84 engage the tooth perimeter surface of the pinion to convey motion of the shaft 76 and lever 96 to the camshaft 106.

Opposite of wall 42, about the first floor 38, is a second vertical wall 140. In some embodiments, there is a gap 142 between the distal end 144 of the plate 18 and the wall 140. Wall 140 is taller than wall 42 and wall 58. The wall 140 comprises a platform 146. The platform 146 supports a second gasket 148, which may comprise rubber. The top of platform and/or the second gasket may be positioned below the top of the platform 44 and/or first gasket to account for thicker distal ends 143, 144 of the plates 16, 18 as compared to a mid-area of the plates 16, 18. The plates 16, 18 can rest on the gaskets 46, 148.

Referring to FIGS. 5, 8, 9, and 11, subsill 26 comprises a floor 150, a first wall 152, and a second wall 154. The first and second walls 152, 154 are engaged by the exterior top plate 14. The second wall 154 comprises a top engagement portion. The top engagement portion comprises a horizontal surface 156, a recess 160, and an angled surface 158. The plate 14 comprises a second wall 162. The second wall 162 comprises a bottom engagement portion. The bottom engagement portion comprises an angled portion 164 and a hook end 166. When the plate 14 is connected to the subsill 26, the hook end 166 is received in the recess 160 and rests on the surface 156, and the angled portion 164 mates with the angled surface 158.

The first wall 152 comprises a top engagement portion. The top engagement portion of the first wall comprises a horizontal surface 168, a recess 172, and an angled surface 170. The plate 14 comprises a first wall 174 opposite of the second wall 162. The first wall comprises a bottom engagement portion. The bottom engagement portion comprises an angled portion 176 and a hook end 178. When the plate 14 is connected to the subsill 26, the hook end 178 is received in the recess 172 and rests on the surface 168, and the angled portion 176 mates with the angled surface 170. By this arrangement the plate 14 is interlocked with the subsill 26. The walls 162, 174 may flex to allow the hook ends 166, 178 to be installed or to be released and removed the plate 14 from the subsill 26.

The plate 16 has a shaft aperture 180 that the shafts, 76, 74 extend through. The actuation lever 78 is located about the shaft 76 below the plate 16 and adjacent to the pinion 92.

As labeled in FIG. 6, base plate 72 comprises a bottom plate 182 and a side plate 184. The top of the side plate 182 comprises a lip 185. The rack 84 is positioned under the lip 185 and adjacent or against the outside surface of the side plate 184. The lip 185 may hold the teeth 88 of the rack 84 engaged with the pinion 92 or otherwise prevent substantial vertical movement of the rack. Further, the side plate 184 may prevent movement of the rack transverse to the rack's longitudinal extent. Therefore, the base plate may provide a guide for the rack. The guide assists in translating the rotational movement of the actuation lever 78 to linear movement of the rack by providing a linear track comprising the lip 185 and the outside wall of side plate 184. The actuation lever 78 is pivotal relative to the rack at the shoulder screw 90. The linear movement of the rack is translated to rotational movement of the pinion 92 and camshaft 106.

The adjustable threshold device 10 is shown in FIG. 1 with a door 8. In practice, the door 8 is attached to a doorjamb (not shown) via one or more hinges (not shown), which are attached to the door on a hinge side 8*b* of the door 8. The door is pivotal about its hinged connection to the doorjamb in the direction A of FIG. 1. When the door is moved open in the direction A, an interior surface 8*a* of the door 8 will contact the door lever cam 98. As the door is moved further in direction A, the door will move the door lever 96 in the direction A rotationally about the shaft 74. The movement of the door lever 96 causes the shaft 76 to rotate relative to shaft 74.

The rotation of shaft 76 causes the actuation lever 78 to rotate with the shaft 76. The movement of actuation lever 78 about the shaft in the direction A, causes the rack 84 to be moved away from the subsill 26 in the direction C of FIG. 5. The movement of the rack 84 in the direction C, causes the pinion 92 and the camshaft 106 to rotate in the direction E. This causes the cam 22 to move from a lowered position, shown in FIGS. 4 and 10, to a raised position, shown in FIGS. 2, 3, and 5.

Figure 3:
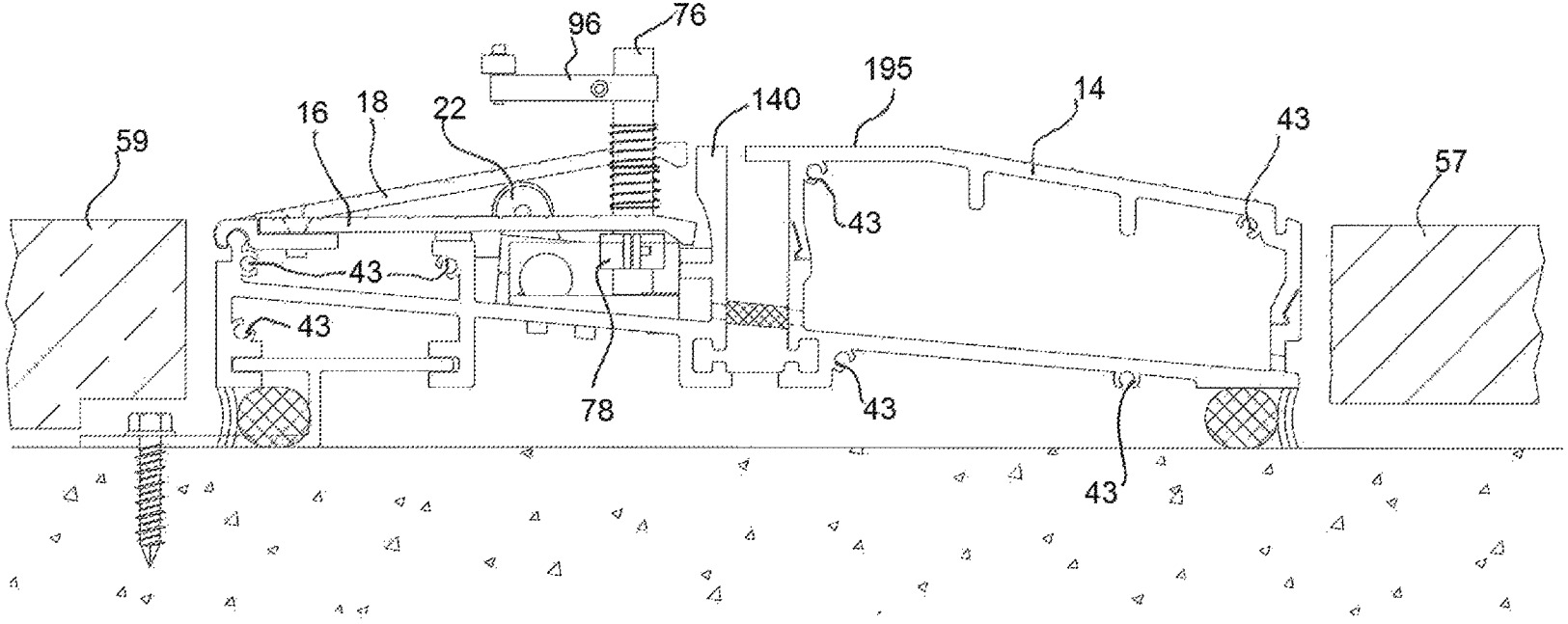
FIG. 3 is a right side view of the device of FIG. 1 with an interior plate in a raised position.
Figure 11:
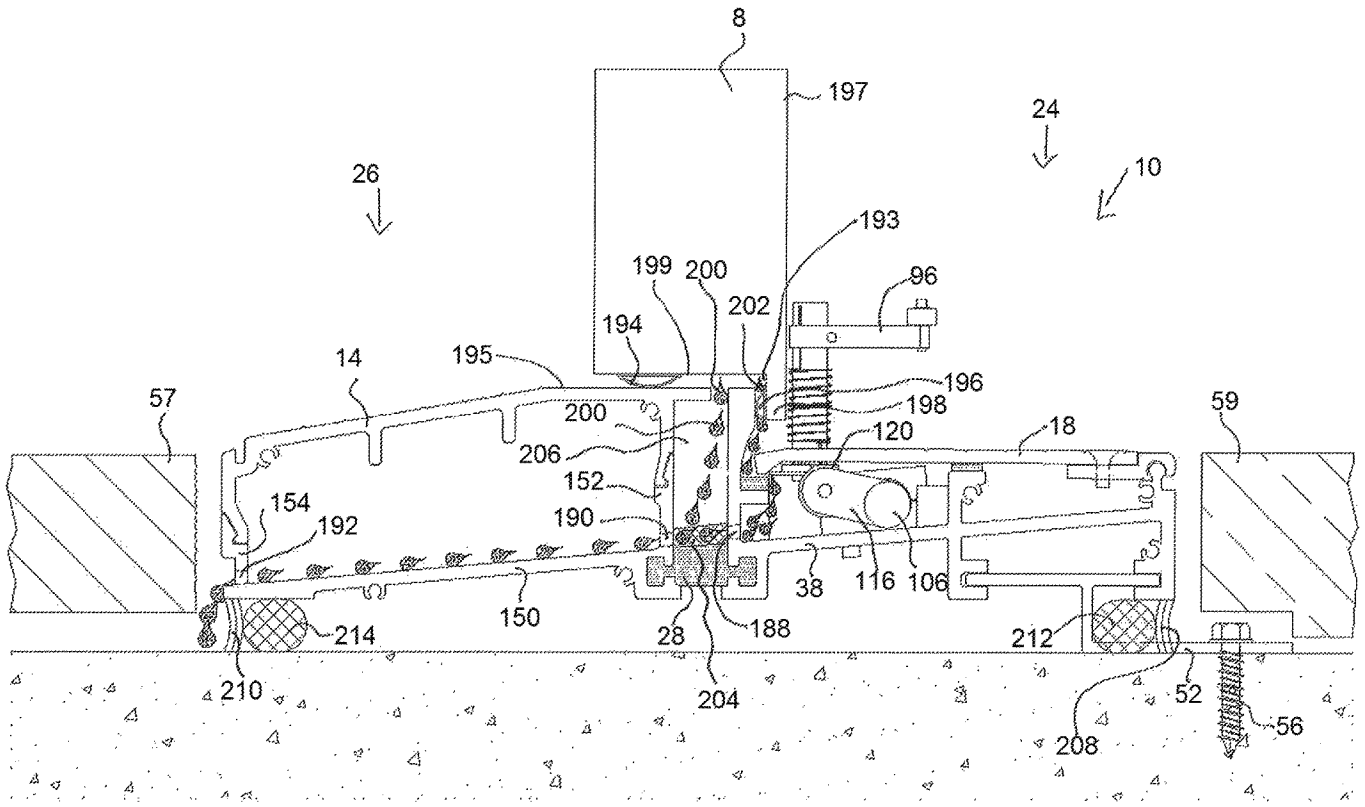
FIG. 11 is a right side view of the device of FIG. 1.

The movement of the cam 22 to the raised position causes the cam 22 to contact the bottom of plate 18 and to move plate 18 from its lowered/recessed position, shown in FIGS. 1 and 11, two it's raised position, shown in FIGS. 2 and 3. When the cam 22 contacts the bottom of plate 18, the roller 120 roles along the bottom surface of the plate 18 as the camshaft 106 rotates. The rolling engagement of the cam relative to the plate 18 reduces friction over a non-roller cam. However, in some embodiments, a non-roller cam may be used.

Adjacent the camshaft 106, is a stop block 186, as shown in FIG. 2. The stop block limits the rotation of the cam in the direction E. As is shown in FIG. 2, the stop block 186 stops the rotation of the cam 22 at a location that is past the 12 o'clock or straight vertical position. Therefore when a person walks on plate 18 or when weight is provided on plate 18, the weight applied to plate 18 will be transferred through the cam to the stop block 186. The weight will cause the cam to rotate or to want to rotate towards the stop block 186. As the cam 22 is past the 12 o'clock position the weight applied to plate 18 will not cause the cam 22 to rotate in the direction F towards the home or lowered position. The stop block 186 is fixed to or formed with the floor 38 and the wall 42. In some embodiments, the stop block 186 stops the cam 22 at 92° from its home position. In some embodiments, the door lever 96 rotates 20° from its home position to its full open position about shaft 74.

In some embodiments, the first and second arms 114, 116 of the cam 22 contact the stop block 186. Therefore, the roller 120 does not contact the stop block 186 and is not prevented from slight rotational movement due to a load being applied to plate 18.

Figure 10:
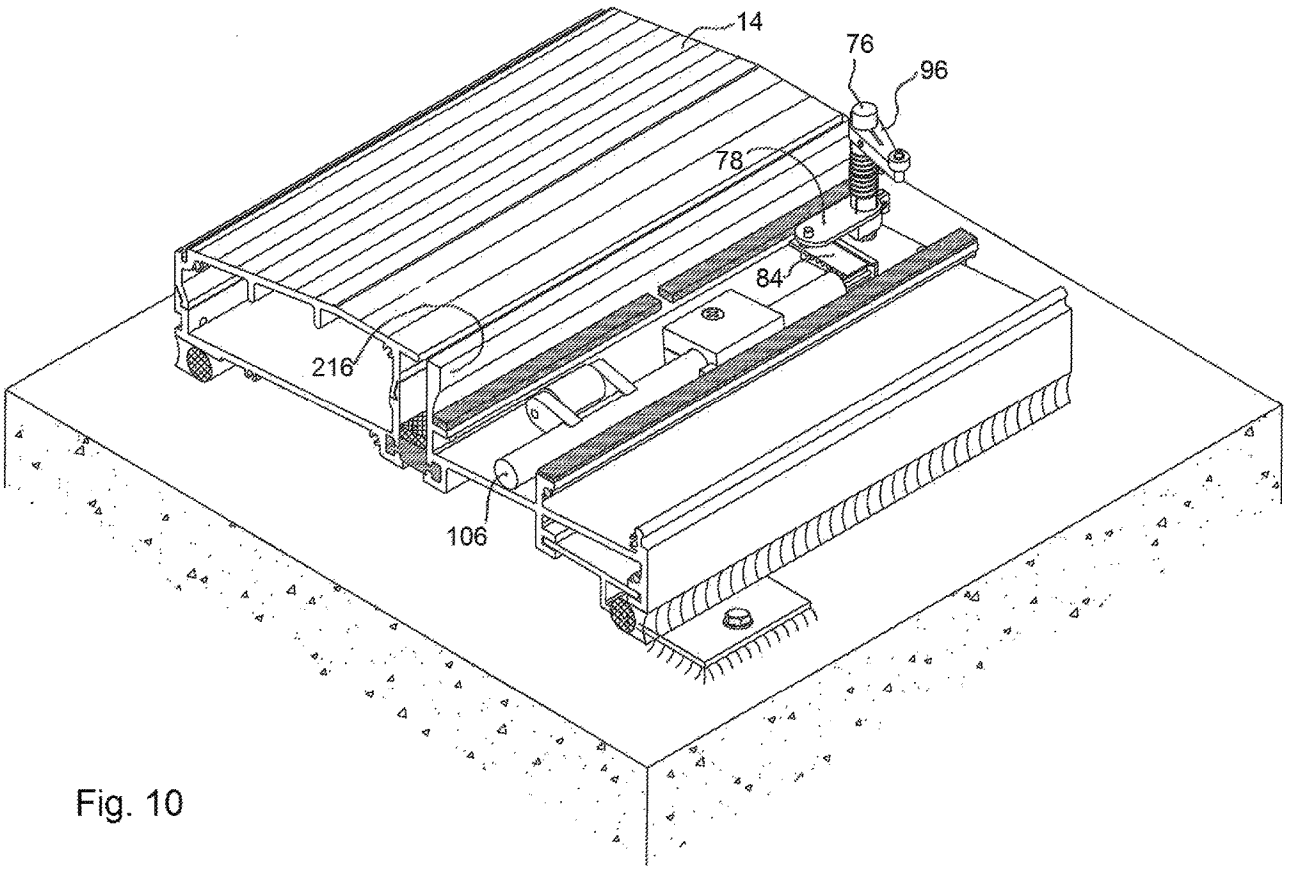
FIG. 10 is a perspective view of the device of FIG. 1 with certain plates not shown.

When the door 8 is moved towards a closed position in the direction B, the spring 94 will cause the lever 96 to rotate in the direction B and follow the movement of the door 8 until the lever 96 reaches its home position. The rotation of the lever in the direction B, will cause the shaft 76 to rotate in the direction B about shaft 74. This will cause the rotation of the actuation lever 78 in the direction B. The movement of the actuation lever 78 in the direction B will draw the rack 84 in the direction D towards subsill 26. The movement of the rack 84 in direction D will cause the pinion 92 and the camshaft 106 to rotate in the direction F towards the home and lowered position as shown in FIG. 10. The plate 18 resting on the cam 22, will lower as the cam moves with the camshaft to the lowered position. When the plate 18 is in the lowered position, it may rest on or be adjacent to gaskets 46, 148. The gaskets 46, 148 provide a noise dampening or eliminating feature to prevent noise that would otherwise be caused by metal-to-metal contact between the plate 18 and platforms 44, 146.

In some embodiments, the device 10 comprises a water drainage system, as shown in FIG. 11. The water drainage system comprises gap 141 and a plurality of water drainage apertures, 188, 190, 192. Water drainage aperture 188 is located in wall 140 at or adjacent the intersection of the wall 140 with the floor 38 of subsill 24. The water drainage aperture 190 is located in wall 152 at or adjacent a floor 150 of subsill 26. Water drainage aperture 192 is located in wall 154 at or adjacent the intersection between wall 154 and floor 150. Water drainage aperture 192 provides an exit from the device 10 allowing water to exit the device on an exterior side of the door 8.

The door 8 may be provided with a first bottom seal 194. The first bottom seal 194 is attached to a bottom surface 199 of the door 8. The first bottom seal 194 is configured to engage a top surface 195 of plate 14 to create a seal between the door and subsill 26. The door may have an interior lip 198. The interior lip 198 extends below a first bottom surface 199 of the door. In some applications the lip 198 is integral with the door. In some applications, the lip 198 is created by a plate or other component attached to the door and extending down below the first bottom surface 199. The lip 198 vertically overlaps the wall 140. A second seal element 196 may be provided on an exterior face of the lip 198. The seal element 196 is configured to engage the wall 140 to create a seal between the door and the subsill 24.

If water or moisture passes the seals 194 and/or 196, the water drainage system of the device 10 provides multiple water flow paths for water to exit the device 10. Water entering under the door on surface 195 may fall along the first flow path 200 at the gap 141 between an end of surface 195 and wall 140. The water will fall through the gap 141 and into the chamber 206 between wall 140 and wall 152. The water will fall into a baffle 204. In some embodiments, the baffle comprises a sponge material. The upper surface of the thermal break 28 is slanted downward towards the exterior as shown in FIG. 11. This causes the water in the baffle 204 and in the chamber 206 to drain and flow towards water drainage aperture 190. The water will flow through the water drainage aperture 190. Since the floor 150 of subsill 26 is slanted downwards towards the exterior, gravity will draw the water along the floor 150, through the aperture 192, and out of the device 10.

Water that passes gap 141 will be blocked from further interior travel by the lip 198. If the water passes the seal 196, then it will fall along a second flow path 202 beginning in the gap 193 between the wall 140 and the lip 198. It will fall on gasket 148 and platform 146. There may be a gap between the bottom of distal end 144 of plate 18 and the top of gasket 148, so that water may move between the plate and gasket down onto floor 38. Floor 38 is slanted toward the exterior. Therefore, gravity will cause water accumulating on the floor 38 to flow towards and through aperture 188. The water will then pass through the baffle 204 and chamber 206, through aperture 190 along the floor 150 by gravity towards aperture 192 and out of the device 10.

The device 10 is typically placed at a door threshold. The device 10 may be located between an exterior finish surface 57 and an interior finish floor 59. In some applications, the exterior finish surface is an exterior concrete paver. Seal elements 208, 210, 212, 214 are placed at or adjacent the interior and exterior bottom edges as shown in FIGS. 2 and 11 to prevent moisture and debris from entering under the device 10. In some embodiments, plates 16, 18 are provided with traction recesses 187, 189 and plate 14 is provided with traction ridges 191.

When the door opens it causes the plate 18 to move to the raised position so that there is little or no drop across the threshold. This provides an unobstructed or substantially unobstructed threshold surface in the directions G and H of FIG. 2. The upper surface of the distal end 144 of the plate 18 is aligned or substantially horizontally aligned with a top surface of wall 140 and the top surface 195 of plate 14. Therefore the distal end 144 of the plate 18 may be co-planar or substantially co-planar with a portion of plate 14 that comprises top surface 195.

Plate 18 provides an inclined to the top of wall 140 which is aligned or substantially aligned with surface 195. Surface 195 continues to a slight downward sloping surface 197, which then transitions to an exterior surface, such as exterior surface 57. This arrangement makes it easy to cross the threshold where the individual or item crossing the threshold does not have to overcome a step or abrupt change in elevation. This is particularly advantageous for a rolling items, such as a wheelchair or a cart. Moreover, this arrangement reduces a tripping hazard for those walking across the threshold.

When the door is closed, the plate 18 is in the lowered position so that a vertical upper surface 216 of wall 140 is exposed. The exposed vertical upper surface 216 of the wall 140 provides a ceiling surface for the lip 198 of the door to engage with. This overlapping arrangement provides improved thermal and weather sealing of the door at the threshold.

In some embodiments, the cam and camshaft are replaced by another type of linear actuator, such as a hydraulic actuator, a pneumatic actuator, or an electro-mechanical actuator.

Figure 12:
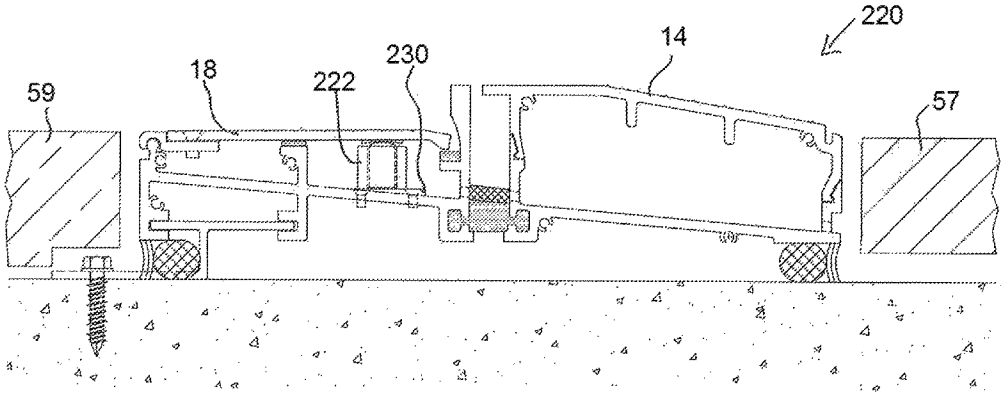
FIG. 12 is a right side view of a second embodiment adjustable threshold device with an interior plate in a lowered position.
Figure 13:
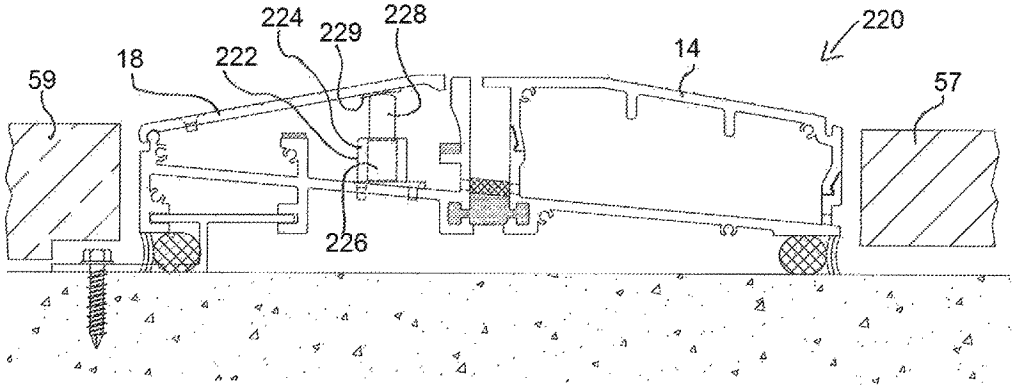
FIG. 13 is a right side view of the device of FIG. 12 with an interior plate in a raised position

A second embodiment adjustable threshold device 220 is shown in FIGS. 12 and 13. Device 220 is the same as device 10 except as shown and described herein. Therefore the same numerals will be used for components of device 220 that are the same as components of device 10. In particular, device 220 comprises a linear actuator 222, such as a hydraulic or pneumatic linear actuator. Actuator 222 replaces the cam and camshaft of device 10. The actuator comprises a housing 224 containing a piston space 226. The actuator comprises a piston 228 that is movable relative to the piston space and the housing. The piston is moveable between a home/recessed position, as shown in FIG. 12, where the piston occupies the piston space and a raised/deployed position, as shown in FIG. 13, where the piston extends out of the housing. The distal end of the piston supports, at least partially, the plate 18 and moves the plate between the lowered position, as shown in FIG. 12, and the raised position, as shown in FIG. 13. The piston may contact the underside plate 18 directly or may contact one or more intermediate components between the piston and the plate, such as a contact pad 229.

The actuator 222 may be supported by a base 230 connected to the floor 38. Since the floor 38 is slanted, the bottom of the base 230 may be shaped, such as triangular shaped, to provide a top level surface for supporting the actuator 222.

In some embodiments, the door lever assembly 20 is used with the actuator 220. However the rack 84 and pinion 92 are not used, instead the actuation lever 78 operates to open a valve (not shown) to cause a fluid, such as air or liquid, to flow into the piston space to cause the piston to move to the raised position. Likewise the lever can close or open a valve to cause fluid to escape the piston space to cause the piston to move to the recessed position.

In some embodiments actuator 220 is an electro-mechanical actuator, comprising a motor (not shown), a lead screw, and a nut (not shown). The motor drives the nut to rotate. The nut is engaged with the screw. The rotation of the nut moves the screw linearly relative to the nut. Therefore the screw can move as piston 228 moves relative to the housing 224. In some embodiments, the door lever assembly 20, or a portion thereof, actuates an electronic switch 258, which signals the electro-mechanical actuator to extend or retract the screw or piston.

In some embodiments, the door lever assembly 20 is not used, an electronic switch or control interface 258 is provided in communication with a controller 254. The switch or control 258 may be mounted on the wall or adjacent the door, which when actuated causes the actuator 222 to raise or lower. In some embodiments, the switch or control interface 258 is centrally located within a building at a location that is not adjacent to the door. In some embodiments, the electronic switch or control interface 258 is provided remotely from the device 220 or the building containing the device 220, and is accessible over a network, such as via a computer or mobile electronic device.

In some embodiments, a combination of electronic switches or control interfaces, electro-mechanical actuators, and hydraulic or pneumatic linear actuators can be used. For example, a control interface 258 may signal the controller 254 to instruct an electro-mechanical actuator 256 to open or close a control valve that actuates the hydraulic or pneumatic linear actuator 222. In some embodiment, multiple actuators 222 are used to raise and lower plate 18.

In some embodiments, the device comprises a sensor that reports to the controller 254 the present state of the plate and or actuator, e.g. raised or lowered. Therefore, the controller knows that position state of the plate 18 and the actuator. In some embodiments, the controller stores in its memory at least the last state of the adjustable threshold device.

Figure 14:
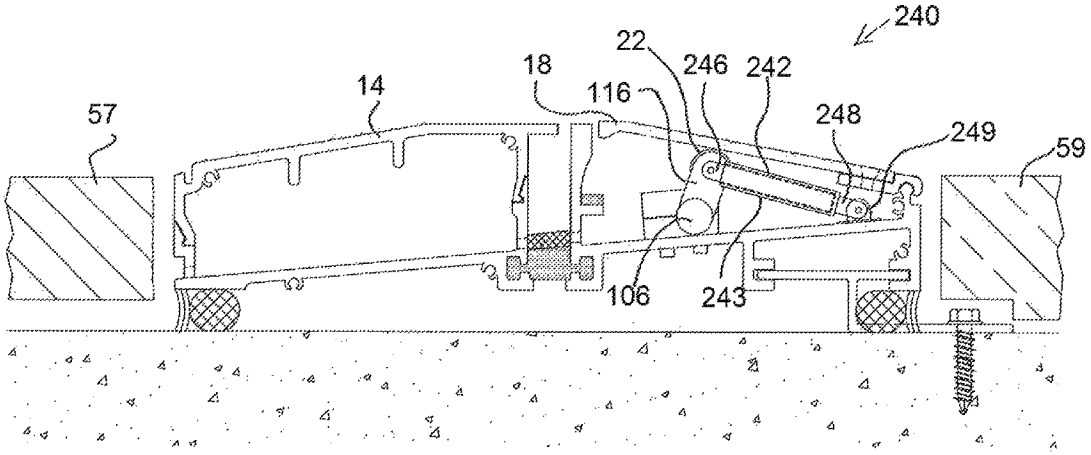
FIG. 14 is a left side view of a third embodiment adjustable threshold device with an interior plate in a raised position.
Figure 15:
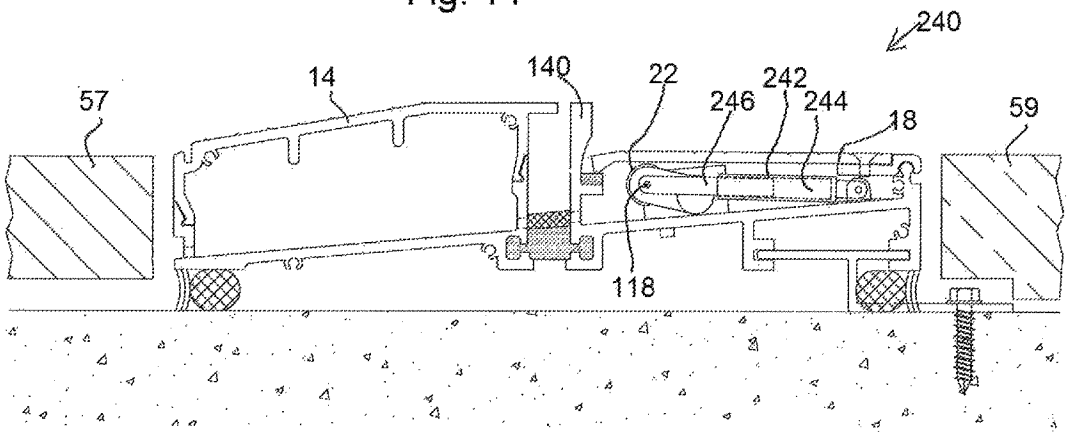
FIG. 15 is a left side view of the device of FIG. 14 with an interior plate in a lowered position.

A third embodiment adjustable threshold device 240 is shown in FIGS. 14 and 15. Device 240 is the same as device 10 except as shown and described herein. Therefore the same numerals will be used for components of device 240 that are the same as components of device 10. In particular, device 240 comprises a linear actuator 242, such as a hydraulic, pneumatic, or electro-mechanical linear actuator. The linear actuator may be described as a ram. The actuator 242 comprises a housing 243 containing a piston space 244.

The housing 243 is pivotally anchored with a base end shaft 248 to a base anchor 249. The distal end of the piston is pivotally attached to the cam 22, such as to the first and/or second arms 114, 116 at or adjacent the central pin 118.

The actuator 242 has a retracted position, as shown in FIG. 14, where the piston 246 is within the piston space 244 and an extended position, as shown in FIG. 15, where the piston is extended from the piston space. The piston rotates, at least partially, about the camshaft 106. Therefore when moving to the extended position the piston moves forward, in the direction of vertical wall 140, and down. When moving to the retracted position, the piston moves backward and up. The home or retracted position of the piston is a raised position and corresponds to the raised position of the plate 18. The extended position of the piston corresponds to the lowered position of the plate 18.

In some embodiments, an electronic motor (not shown) drives an output shaft that comprises an output gear (not shown) that is enmeshed with pinion 92 of device 10. A switch or control interface 258, usually via a controller 254, signals the motor to rotate the output shaft in either rotational direction to cause the camshaft to rotate, which causes the cam to raise or lower. In some embodiments, if the door lever assembly is used, a rack 84 is not used, but rather the assembly engages the switch 258. The actuation lever 78 may engage the switch or the switch may be configured to otherwise detect the rotational movement of the shaft 76 without the use of an actuation lever 78.

In some embodiments, an interior motion sensor 250 and/or an exterior motion sensor 252 is used. In some embodiments, the motion sensor 250, 252 is or comprises a passive infrared sensor, a microwave sensor, an ultrasonic sensor, or an optical sensor. The sensor may have a wired or wireless transceiver.

Figures 16, 17:
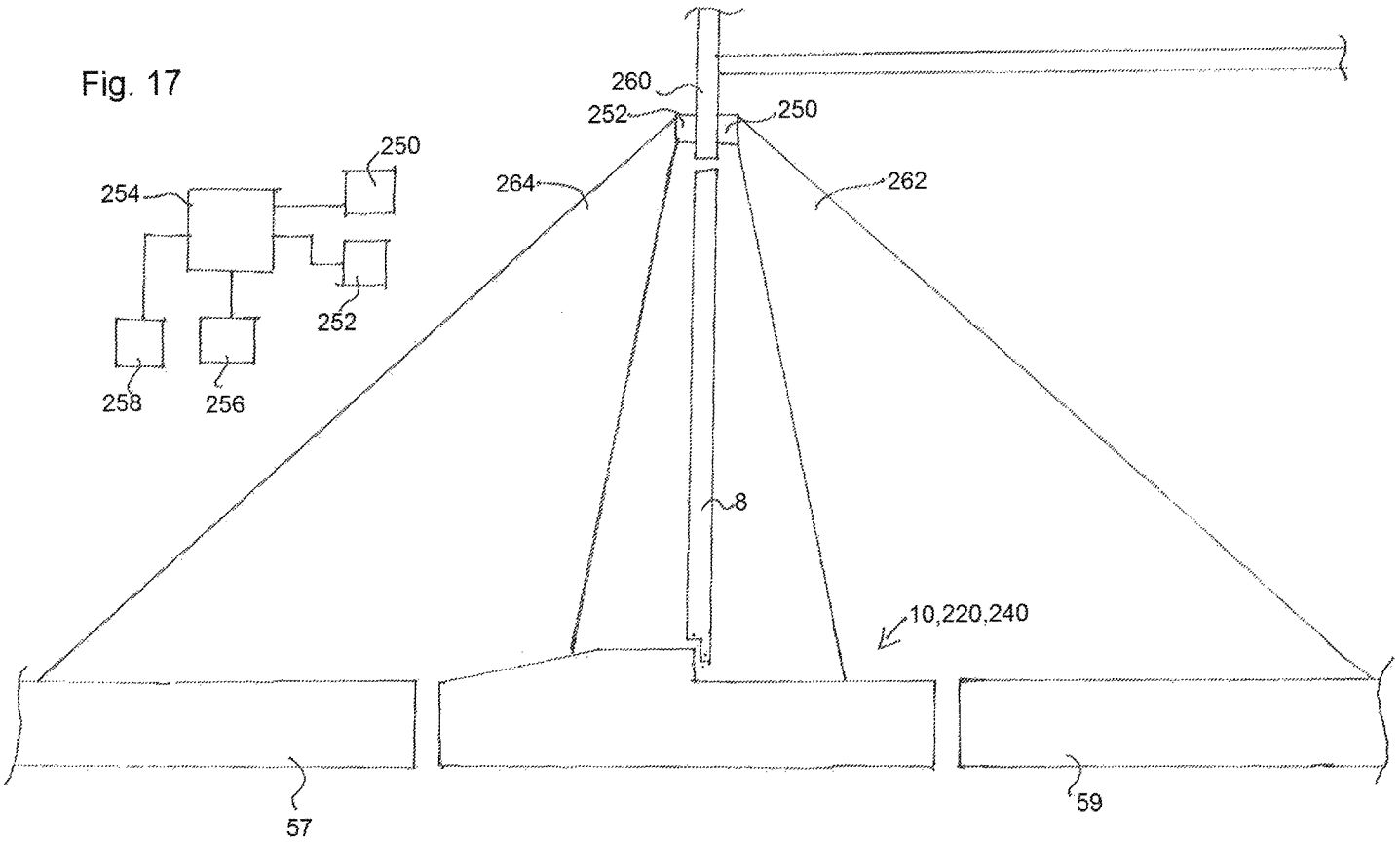
FIG. 16 is a side view of an adjustable threshold device of the invention in an exemplary deployment.
FIG. 17 is a block diagram of certain components of an embodiment of the invention.

The motion sensors 250, 252 are in signal communication to the controller 254, such as by wired or wireless communication. The motion sensors are configured to detect motion within a sensing field 262, 264. Exemplary sensing fields are shown in FIG. 16. The sensing fields extend in front of the door 8 on an exterior and/or and interior side of the door. The sensing fields may be wider or narrower than is shown in FIG. 16. The sensing fields may extend closer or farther from the door than is shown in FIG. 16. One skilled in the art will recognize the sensing field scope and area may be configured as desired for a given application. In some embodiments, the motion sensors have multiple sensing fields, which may overlap. The sensors 250, 252 are shown mounted to the wall 260 above the door opening, but they may be mounted in other places as long as the sensing fields are directed to area(s) in front of the door.

Motion sensors 250, 252 are configured to signal to the controller 254 when motion is detected with the sensing fields. Motion may be detected when a person or object approaches the door and is within or partially within, the sensing field. When the motion sensor detects motion within the sensing field, the motion sensor will send a signal to the controller 254. Then the controller will send instructions to cause the linear actuator to raise the plate 18 to the raised position. The controller may send instructions to the linear actuator itself, as in the case of an electro-mechanical linear actuator, or to an intermediate component that will then cause the linear actuator to actuate, such as by signaling the intermediate actuator 256 that actuates a valve that controls the linear actuator 222, 242. In some embodiments, the door is openable by a door actuator (not shown). The controller may first instruct the door actuator to open the door. Then, at least when the door has cleared the area above the plate 18, the controller may instruct the linear actuator to raise the plate 18 to the raised position. After a pre-determined amount of time has passed without the controller receiving a signal from the motion sensor(s) indicating motion within the sensing field, the controller will send a signal to cause the linear actuator to lower the plate 18. The controller may then send a signal to the door actuator to close the door 8.

In some embodiments, controller 254 comprises a processor, a memory, and a wired and/or wireless transceiver. Each of the processor, a memory, and a wired and/or wireless transceiver are connected to each other by one or more internal communication channels. The memory may comprise a non-volatile memory such as flash memory and/or a volatile memory such as RAM. Such components are in communication with one another across one or more communication channels. In some embodiments, the controller comprises a battery and or is connectable to an external power source. Other architectures for the controller are possible, including architectures with more or fewer components.

In some embodiments, the controller comprises an application-specific integrated circuit (ASIC) having one or more processors and memory blocks including ROM, RAM, EEPROM, Flash, or the like; a programmed general purpose computer having a microprocessor, microcontroller, or other processor, a memory, and an input/output device; a programmable integrated electronic circuit; a programmable logic device; or the like. Any device or combination of devices on which a finite state machine capable of implementing the procedures described herein can be used as the controller.

From the foregoing, it will be observed that numerous variations and modifications may be effected without departing from the spirit and scope of the invention. It is to be understood that no limitation with respect to the specific apparatus illustrated herein is intended or should be inferred. For example, one or more component or embodiments may be combined, modified, removed, or supplemented to form further embodiments within the scope of the invention. As a further example, steps provided could be carried out in a different order to achieve desired results. Further, steps could be added or removed from the processes described. Therefore, other embodiments and implementations are within the scope of the invention.

The invention claimed is:

1. An adjustable door threshold device, comprising:

a first threshold surface portion and a second threshold surface portion;

a transverse surface positioned transverse to the first threshold surface portion and between the first threshold surface portion and second threshold surface portions, and;

a lift mechanism configured to move the first threshold surface portion from a lowered position to a raised position, when the first threshold surface portion is in the raised position adjacent portions of the first threshold surface portion and the second threshold surface portion are substantially horizontally aligned and the transverse surface does not extend substantially above the first threshold surface portion, when the first threshold surface portion is in the lowered position the first threshold surface portion is recessed from the second threshold surface portion and the transverse surface extends above the first threshold surface portion for overlapped mating with a door lip.

2. The device of claim 1, comprising a door lever configured to engage a door and to move with the door between a home position and an end position, the door lever operably connected to the lift mechanism; the door lever drives the lift mechanism to move the first threshold surface portion from the lowered position to the raised position.

3. The device of claim 2, comprising a spring, the spring biases the door lever to the home position.

4. The device of claim 1, wherein the lift mechanism comprises a cam; the cam drives the first threshold surface portion to the raised position.

5. The device of claim 1, comprising a first plate comprising the first threshold surface portion, and wherein the lift mechanism comprises a cam; the cam drives the first threshold surface portion to the raised position.

6. The device of claim 1, comprising a subsill;

a first plate;

a door lever assembly comprising a door lever, a vertical shaft, an actuation lever, an actuation rack, a pinion, a spring;

the lift mechanism comprising a camshaft, a cam, and a bearing block;

the bearing block is mounted to the subsill, the vertical shaft is rotatably mounted to the subsill, the camshaft rotatably supported by the bearing block;

the door lever and the actuation lever are fixed to the vertical shaft;

the spring biases the door lever to a home position;

the door lever is located above the first threshold surface portion;

the actuation lever is located below the first threshold surface portion;

the actuation rack is connected to the actuation lever;

the actuation rack is enmeshed with the pinion, the rack drives the pinion to rotate;

the pinion drives the camshaft to rotate;

the first plate comprising the first threshold surface portion; and, the first threshold surface portion moves pivotally, as driven by the cam, between the lowered position and the raised position relative to the subsill.

7. The device of claim 1, wherein a drainage gap exists between the first threshold surface portion and the second threshold surface portion.

8. The device of claim 1, comprising a vertical plate, the vertical plate comprises the transverse surface and a top surface; the threshold comprises the top surface between the first threshold surface portion and the second threshold surface portion.

9. The device of claim 8, comprising a first drainage gap and a second drainage gap, the first drainage gap is between the first threshold surface portion and the top surface, the second drainage gap is between the top surface and the second threshold surface portion.

10. The device of claim 1, comprising a vertical plate, the vertical plate comprises the transverse surface and the second threshold surface portion.

11. The device of claim 1, wherein the first threshold surface portion is inclined when in the raised position and horizontal when in the lowered position.

12. The device of claim 1, comprising a subsill supporting the first threshold surface portion, the second threshold surface portion, the transverse surface, and, the lift mechanism; the subsill comprises a floor, the floor declines from an interior side to an exterior side of the subsill.

13. The device of claim 1, wherein the lift mechanism comprises a linear actuator, the linear actuator configured to move the first threshold surface portion to the raised position.

14. The device of claim 1, wherein the lift mechanism comprises a switch and a linear actuator, an actuation of the switch causes the linear actuator to move the first threshold surface portion to the raised position.

15. The device of claim 1, wherein the lift mechanism comprises a motion sensor and a linear actuator, wherein a detection of motion by the motion sensor causes the linear actuator move the first threshold surface portion to the raised position.

16. An adjustable door threshold device, comprising:

a base;

an interior plate supported by the base;

an second plate supported by the base;

a threshold comprising an upper surface of the interior plate and an upper surface of the second plate;

a door lip mating surface transverse to the interior plate; and, a linear actuator configured to move the interior plate between a lowered position and a raised position, when the interior plate is in the raised position adjacent portions of the interior plate and the second plate are substantially co-planer, when the interior plate is in the lowered position the interior plate is recessed from the second plate and the door lip mating surface extends above the interior plate.

17. The device of claim 16, comprising a door lever configured engage a door and to move with the door between a home position and an end position, the door lever operably connected to the linear actuator; the door lever drives the linear actuator to move the interior plate from the lowered position to the raised position.

18. An adjustable door threshold device, comprising:

a movable threshold surface;

a fixed threshold surface;

a door lip mating surface positioned transverse to the movable threshold surface and between the movable threshold surface and the fixed threshold surface, and;

a linear actuator configured to move the movable threshold surface from a lowered position to a raised position, when the movable threshold surface is in the raised position adjacent portions of the movable threshold surface and the fixed threshold surface are substantially horizontally aligned and the door lip mating surface does not extend substantially above the movable threshold surface, when the movable threshold surface is in the lowered position the movable threshold surface is recessed from the fixed threshold surface and the door lip mating surface extends above the movable threshold surface.

19. The device of claim 18, comprising a door lever configured engage a door and to move with the door between a home position and an end position, the door lever operably connected to the linear actuator; the door lever drives the linear actuator to move the movable threshold surface from the lowered position to the raised position.

20. The device of claim 18, wherein a linear actuator is selected from the group consisting of: a cam, a screw, a hydraulic linear actuator, and a pneumatic linear actuator.

* * * * *